US007624759B1

(12) United States Patent
Ismert et al.

(10) Patent No.: US 7,624,759 B1
(45) Date of Patent: Dec. 1, 2009

(54) SHOWER DRAIN TEST PLUG

(75) Inventors: Joseph P. Ismert, Kansas City, MO (US); Frank D. Julian, Kansas City, MO (US); Christopher J. Ismert, Kansas City, MO (US)

(73) Assignee: Sioux Chief Mfg. Co., Inc., Peculiar, MO (US)

( * ) Notice: Subject to any disclaimer, the term of this patent is extended or adjusted under 35 U.S.C. 154(b) by 0 days.

(21) Appl. No.: 12/187,777

(22) Filed: Aug. 7, 2008

(51) Int. Cl.
*F16L 55/10* (2006.01)

(52) U.S. Cl. ..... 138/89; 138/90; 4/295; 4/293; 292/256.6; 220/314

(58) Field of Classification Search ..... 138/89, 138/90; 4/295, 293, 286, 252.1, 252.6, 252.5, 4/252.4; 220/241, 233, 300, 314; 292/256.6
See application file for complete search history.

(56) References Cited

U.S. PATENT DOCUMENTS

| | | | | | |
|---|---|---|---|---|---|
| 1,058,277 | A | * | 4/1913 | Tucker | 4/295 |
| 1,766,621 | A | | 6/1930 | Fleming | |
| 1,826,555 | A | | 10/1931 | Lonskey | |
| 2,471,301 | A | | 5/1949 | Boosey | |
| 2,667,139 | A | * | 1/1954 | Campbell | 269/48.1 |
| 2,743,786 | A | | 5/1956 | Boosey | |
| 3,457,570 | A | * | 7/1969 | Williams | 4/292 |
| 4,122,592 | A | * | 10/1978 | Ehret et al. | 29/404 |
| 4,506,705 | A | | 3/1985 | Thompson | |
| 5,115,554 | A | * | 5/1992 | Fell, Sr. | 4/252.4 |
| 5,307,841 | A | | 5/1994 | Condon | |
| 5,329,971 | A | * | 7/1994 | Condon | 138/89 |
| 5,351,718 | A | | 10/1994 | Barton | |
| 5,695,222 | A | * | 12/1997 | Hodges | 285/3 |
| 5,819,328 | A | * | 10/1998 | Lewis | 4/295 |
| 5,975,142 | A | | 11/1999 | Wilson | |
| 6,065,160 | A | * | 5/2000 | Winn | 4/252.1 |
| 6,116,285 | A | | 9/2000 | Wilson | |
| 6,637,464 | B1 | | 10/2003 | Cornwall | |
| 6,725,468 | B2 | * | 4/2004 | Molina | 4/252.1 |
| 6,836,911 | B2 | * | 1/2005 | Minnick | 4/694 |
| 2003/0093855 | A1 | * | 5/2003 | Rendell | 4/252.4 |

OTHER PUBLICATIONS

Advertising materials of Jones Stephens Corporation showing Code Blue EZ Test shower drains. Exact date of publication unknown but believed to be more than one year prior to the filing date of the present application.

* cited by examiner

*Primary Examiner*—Patrick F Brinson
(74) *Attorney, Agent, or Firm*—Erickson, Kernell, Derusseau & Kleypas, LLC

(57) ABSTRACT

A test plug for a shower drain includes a threaded portion having external threads sized to be received in an threaded aperture of a drain. An extension extends downwardly from the threaded portion to a cylindrical sealing portion which is connected to the extension below the threaded portion. The sealing portion includes an elastomeric sealing ring extending circumferentially around the sealing portion. The test plug further includes a pair of alignment tabs which extending radially outward from the test plug above the elastomeric sealing ring.

22 Claims, 3 Drawing Sheets

Fig. 4.
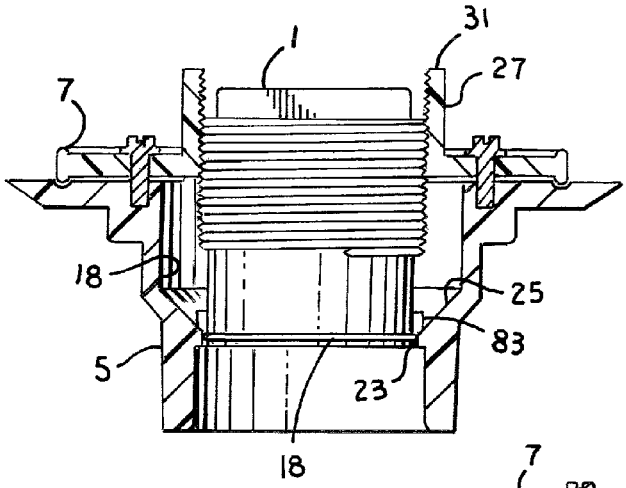
Fig. 5.
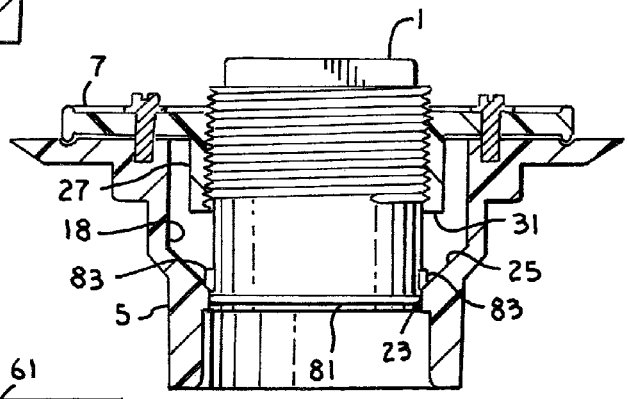
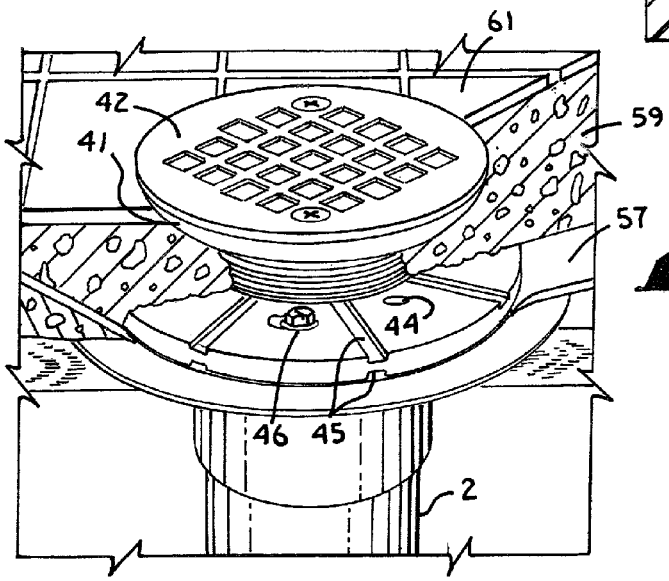
Fig. 6.

SHOWER DRAIN TEST PLUG

BACKGROUND OF THE INVENTION

1. Field of the Invention

This invention relates to caps or plugs for temporarily sealing plumbing systems in structures for testing, and in particular to a plug for temporarily sealing a shower pan drain.

2. Description of the Related Art

Drainage systems are used in structures to carry away waste water, human wastes, ground garbage from disposers, and the like to municipal sewers or septic tanks. Drainage systems also serve as conduit for noxious gases which are vented to the atmosphere outside of the structure. A particularly necessary quality of such drainage systems is integrity of the pipes and joints such that the liquids or gases carried do not leak.

In order to ensure that a drainage system does not leak, pressure testing is often conducted and may be required by some local codes. Plumbing is preferably installed, tested, and joints repaired, as needed, prior to closing access to the piping and joints by the installation of wallboards. Pressure testing often involves pressurizing the drainage system with compressed air, or alternatively filling it with water, and detecting any leaks. Pressure testing is usually done before any fixtures, appliances, or the like have been connected to the drainage system.

Plastics, such as PVC (polyvinyl chloride), ABS (acrylonitrile butadiene styrene) and others, are used in many types of plumbing, including waste plumbing. It is common practice, during pressure testing, to install removable test plugs or caps on pipe stubs to which fixtures, such as toilets, will be subsequently connected. After pressure testing is completed, the caps are removed. The test caps need to be sealed in place such that they do not leak during testing. When the test caps are no longer needed, they need to be removed in such a manner that the test cap is not lost in the waste plumbing, such that the remaining plumbing is not damaged by removal of the test cap, and such that no remaining parts of the test cap assembly interfere with the fixture to be installed.

During testing of a drainage system, drains such as shower pan drains and floor drains also need to be sealed. Shower pan drains typically include a body that connects to the drainage system and a collar which is removably connected to the body by bolts or the like. A flexible membrane which seals the shower floor is clamped between the body and the collar. The finished shower floor is installed on top of the membrane. The collar includes a central threaded aperture which receives a drain head, including a strainer. The collar also includes numerous smaller openings which are intended to direct any water which seeps through the finished floor around the drain head back into the drain.

Sealing a pan drain for pressure testing can be particularly problematic because merely plugging the central aperture still leaves these smaller openings unplugged allowing the pressurized fluid to escape therethrough. What is needed is a test plug for a shower pan drain which can seal the drain at a point below the collar so that no openings are left unplugged.

In addition to pressure testing of the drainage system, the shower pan itself needs to be tested for leaks. In this test, the shower drain is plugged and the pan is filled with water. The water is allowed to stand in the pan, and the pan is checked for leaks. Ideally, the same shower drain test plug can be used for both pressure testing of the drainage system and leak testing of the shower pan.

SUMMARY OF THE INVENTION

The present invention comprises a test plug for a shower drain including a threaded portion having external threads sized to be received in the aperture of the drain collar. An extension extends downwardly from the threaded portion to a cylindrical sealing portion which is connected to the extension below the threaded portion. The sealing portion includes an elastomeric sealing ring extending circumferentially around the sealing portion. The test plug further includes a pair of alignment tabs which extending radially outward from the test plug above the elastomeric sealing ring.

The test plug is installed with the threaded portion threadably engaged with the central aperture of the collar. The sealing portion extends downwardly into a bore of the drain body where the elastomeric sealing ring can seat against a cylindrical side wall of the bore below the collar. The alignment tabs engage an annular wall of the drain body positioned above the cylindrical side wall in order to align the elastomeric sealing ring with the cylindrical side wall.

With the bore of the drain closed off by the sealing portion of the test plug, no pressurized fluid can enter the drain body during testing and, therefore, none of the fluid can leak out thought the smaller openings in the collar.

BRIEF DESCRIPTION OF THE DRAWINGS

FIG. 4 is a cross-sectional view of the drain showing the test plug installed and with a collar of the drain installed in an upwardly extending orientation.

FIG. 5 is a view similar to FIG. 4 showing the drain with the collar installed in a downwardly extending orientation.

FIG. 6 is a fragmentary view of a shower floor with a portion of the finished floor broken away to show the drain with a drain head installed.

DETAILED DESCRIPTION OF THE PREFERRED EMBODIMENTS

Figure 1:
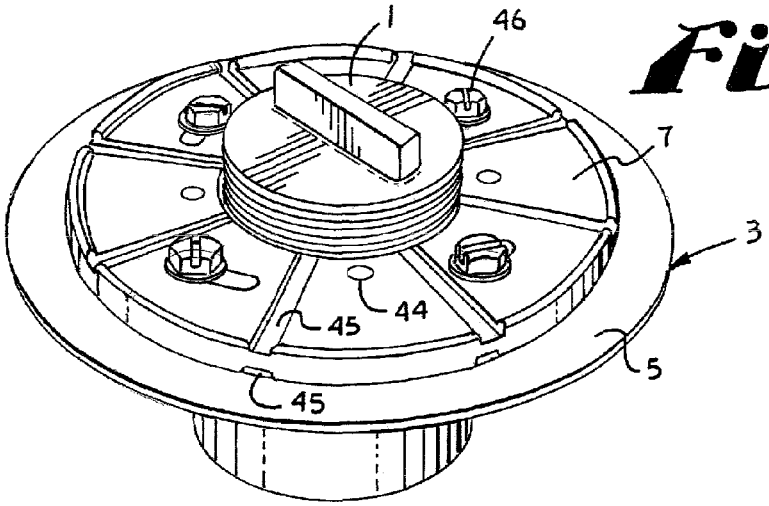
FIG. 1 is a perspective view of a shower drain showing a test plug according to the present invention installed therein.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a test plug for a shower drain according to the present invention (hereinafter "plug 1"). The plug 1 is for use in temporarily sealing a shower pan drain 3 for purposes of testing a drainage system including a drain pipe 2 to which the drain 3 is connected.

Figure 2:
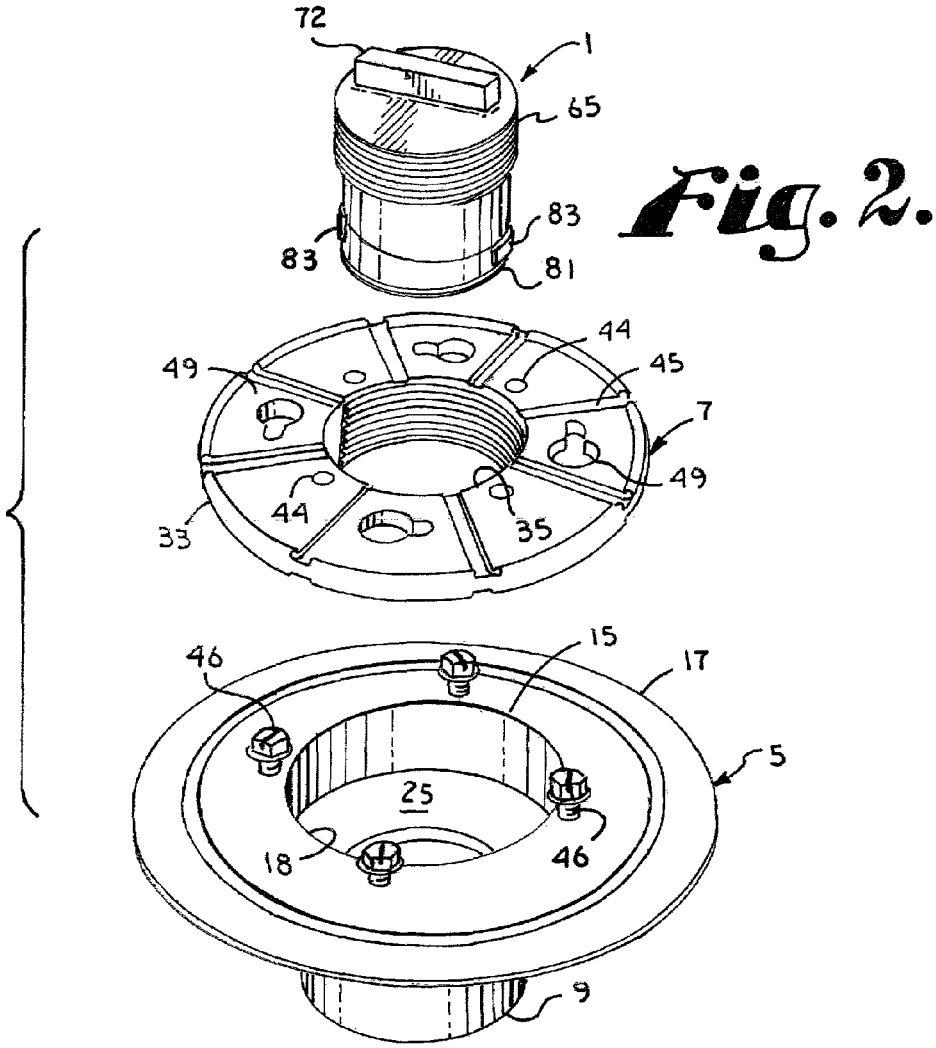
FIG. 2 is an exploded perspective view of the drain and test plug.
Figure 3:
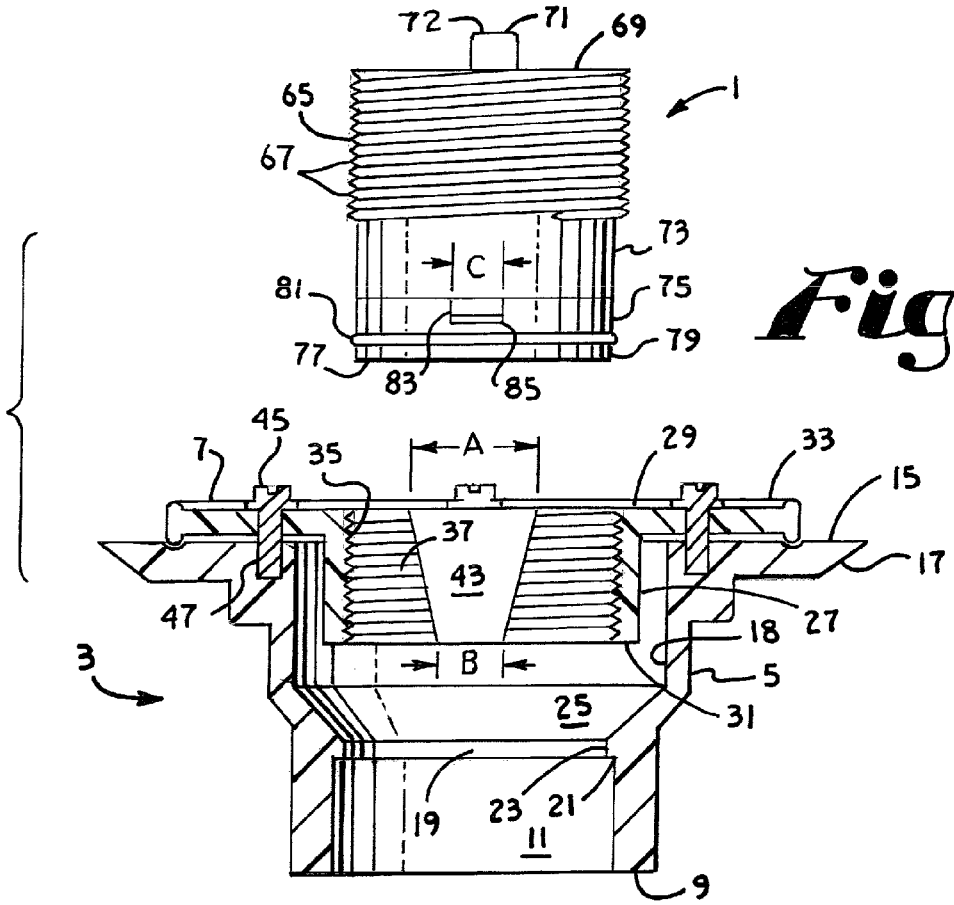
FIG. 3 is a cross-sectional view of the drain with the test plug positioned thereabove prior to installation.

Referring to FIGS. 1-3, the drain 3 is of the type generally including a drain body 5 and a collar 7 removably connected to a top portion of the drain body 5. A typical drain of this type is the 821 Series Pan Drain manufactured by Sioux Chief Mfg. Co., Inc. of Peculiar, Mo. As best seen in FIG. 3, the drain body 5 of the drain 3 includes a lower end 9 having a socket 11 connectable to a drain pipe 2, and an upper end 15 with an outwardly extending radial flange 17. A central drain bore 18 extends through the drain body 5 and communicates with the socket 11. A pipe stop 19 is formed in the drain bore 18 at the top of the socket 11. The pipe stop 19 includes a lower annular wall 21 and a relatively narrow cylindrical side wall 23 above the lower annular wall 21 which is concentric with the drain bore 18. Above the pipe stop 19, the drain bore 18 is widened by an upper annular wall 25 which slopes upwardly and outwardly from the side wall 23 of the pipe stop 19.

The collar 7 includes a sleeve 27 having first and second ends 29 and 31 respectively, and a flange 33 which extends radially outward from the sleeve 27 at the first end 29 thereof. The sleeve 27 forms a central aperture 35 having internal threads 37 for receiving a threaded stem 39 of a drain head 41 topped with a strainer 42 (see FIG. 6). The threads 37 are typically straight threads and are of an interrupted design having a pair of diametrically opposed vertical channels 43 formed therethrough. The channels 43 serve to allow any water that seeps around the drain head 41 to run through the central aperture 35. The channels 43 may be tapered and have a width which varies from a maximum width A to a minimum width B. The flange 33 of the collar 7 also includes a plurality of openings 44 which provide additional passageways to direct seepage back into the drain bore 18. Radial grooves 45 formed in the upper and lower surfaces of the flange 33 also function to channel water back into the drain bore 18.

The collar 7 is removably fastened to the drain body 5 by a plurality of bolts 46 (four shown) which interconnect the flange 33 of the collar 7 and the flange 17 of the drain body 5. The bolts 46 threadably engage threaded receivers 47 in the drain body 5. Keyhole shaped openings 49 are provided in the flange 33 of the collar 7 for receiving the heads of the bolts 46. The bolts 46 may be started into the receivers 47 in the body 5 and then the collar 7 may be attached by inserting the heads of the bolts 46 through the large portion of the openings 49 and then rotating the collar 7 until the narrow portions of the openings 49 are under the heads of the bolts 46, thereby locking the collar 7 in place. The collar 7 is usually mounted on the drain body 5 with the second end 31 of the sleeve 27 extending downwardly into the drain bore 18 as shown in FIGS. 3 and 5, however, in some applications, the collar 7 may be mounted with the second end 31 of the sleeve 27 extending upwardly away from the drain body 5 as shown in FIG. 4. When the collar 7 is mounted on the drain body 5 in either orientation, the aperture 35 is axially aligned with the drain bore 18 and may be considered an extension or portion of the drain bore 18.

Referring to FIG. 6, the drain 3 is typically connected to the drain pipe 2 and installed in a shower floor 51 above a sub-floor 53. A first layer 55 of mortar is built up on the sub-floor 55 and sloped toward the drain 3. A flexible membrane 57 is then installed on top of the first layer of mortar 55 and clamped between the collar 7 and drain body 5. The drain head 41 is then installed and a second layer 59 of mortar is poured on top of the membrane 57. A floor covering 61, such as ceramic tile, is installed on top of the second layer 59 of mortar to a finished level generally even with the strainer 42 on the top of the drain head 41.

Testing of the drain system including the drain pipe 2 typically takes place before installation of the drain head 41. In order to test the system, the drain 3 must be temporarily sealed so as to be airtight. It is insufficient to merely install a standard pipe plug (not shown) in the central aperture 35 of the collar 7 because pressurized fluid would still be able to escape past the collar 7 through openings left by the channels 43 in the threads 37, through the openings 49 around the bolts 46, and through any other openings in the collar 7 (such as openings 44 in the flange 33) which might be in communication with the drain bore 18. The test plug 1 solves this problem by sealing the drain bore 18 at a point below the collar 7.

Referring to FIGS. 2 and 3, the plug 1 is generally cylindrical and is preferably hollow to conserve material. The plug 1 includes an upper threaded portion 65 sized to be received in the central aperture 35 of the collar 7 and having external threads 67 sized to engage the internal threads 37 of the aperture 35. A top wall 69 sealingly covers an upper end of the threaded portion 65. Gripping means 71, such as an upstanding flange 72 formed on the top wall 69, are provided on the plug 1 for gripping by hand or with a wrench, pliers, or the like for turning the plug 1 in the aperture 35. The gripping means 71 could also, for example, comprise a square or hexagonal protrusion (not shown) extending upward from the top wall 69, a square or hexagonal indentation (not shown) in the top wall 69 for engagement by a socket or allen wrench, or flattened gripping surfaces (not shown) around the periphery of the plug 1 above the threaded portion 65.

A cylindrical extension 73 extends downwardly from the threaded portion 65 to sealing portion 75 proximate a lower end 77 of the plug 1. The extension 73 has a length sufficient to position the sealing portion 75 inside the cylindrical side wall 23 of the pipe stop 19 when at least some of the external threads 67 of the threaded portion 65 are engaged with the internal threads 37 of the collar 7. Preferably, the length of the cylindrical extension 73 is selected to allow placement of the sealing portion 75 inside of the cylindrical wall 23 regardless of whether the collar 7 mounted on the drain body 5 with the second end 31 of the sleeve 27 extending downwardly into the drain bore 18 (FIGS. 3 and 5) or with the second end 31 of the sleeve 27 extending upwardly away from the drain body 5 (FIG. 4).

The sealing portion 75 of the plug 1 has a diameter selected to closely match the internal diameter of the cylindrical wall 23 of the pipe stop 19 and includes a circumferential groove 79 formed around the plug 1 proximate the lower end 77. The groove 79 seats an elastomeric sealing ring or O-ring 81 which engages the cylindrical wall 23 to form an airtight seal when the plug 1 is installed in the drain 3.

Because the cylindrical wall 23 of the pipe stop 19 is relatively narrow, the O-ring 81 on the sealing portion 75 of the plug 1 must be accurately positioned in order to properly align with and seal against the cylindrical wall 23. In order to insure proper positioning of the O-ring 81, the plug 1 includes a pair of diametrically opposed stops or alignment tabs 83 which extend outwardly from the sealing portion 75 of the plug 1 above the O-ring 81. Each alignment tab 83 has a lower surface 85 which engages the upper annular wall 25 of the drain body 7 as the plug 1 is advanced into the drain bore 18 to prevent further advancement of the plug 1. The lower surfaces 85 are preferably sloped to generally match the slope of the upper annular wall 25. The alignment tabs 83 each have a width C selected to allow the tabs to be inserted into the drain bore 18 by fitment through the channels 43 formed through the internal threads 37 of the collar sleeve 27. The width C of each tab 83 is thus less than the minimum width B of the respective channel 43.

Although two alignment tabs 83 are shown, it is to be understood that a single stop 83 could also be used. In addition, more than two alignment tabs 83 could be used if the respective drain 3 included at least a corresponding number of channels 43. It is to be understood that in any application the number of channels 43 could exceed the number of tabs 83.

In use, the drain body 5 of the drain 3 is connected to the drain pipe 2 and installed in a shower floor 51. The collar 7 is installed on the body 5 using the bolts 46, typically with the flexible membrane 57 clamped between the body 5 and collar 7. Before installation of the drain head 41 and completion of the second layer 59 of mortar, the plug 1 is installed in the drain 3 for testing of the drain system including the drain pipe 2. The plug 1 is installed by first aligning the alignment tabs 83 with the channels 43 which extend through the threads 37. The plug 1 is then pushed downwardly until the tabs 83 clear the lower end of the sleeve 27 (which may be either the first end 29 or second end 31 of the sleeve 27, depending on its orientation when installed). Once the tabs 83 clear the channels 43, the plug 1 will become freely rotatable, allowing the external threads 67 to threadably engage the internal threads 37 of the collar 7. The plug 1 is then rotated using the gripping means 71 to advance the sealing portion 75 downwardly toward the pipe stop 19. When the sealing portion 75 reaches the pipe stop 19, the O-ring 81 will come into sealing engagement with the cylindrical wall 23. As the plug 1 continues to advance downwardly, the alignment tabs 83 will come into contact with the upper annular wall 23, preventing further downward movement of the plug 1 and insuring proper alignment between the O-ring 81 and the annular wall 23.

After the plug 1 is installed, the drain system can be pressure tested. The plug 1 is left in place for leak testing of the pan. After all testing is completed, the plug 1 is removed, the drain head 41 is installed, and the shower floor 51 (including the second layer 59 of mortar and the floor covering 61) may be completed.

Figure 7:
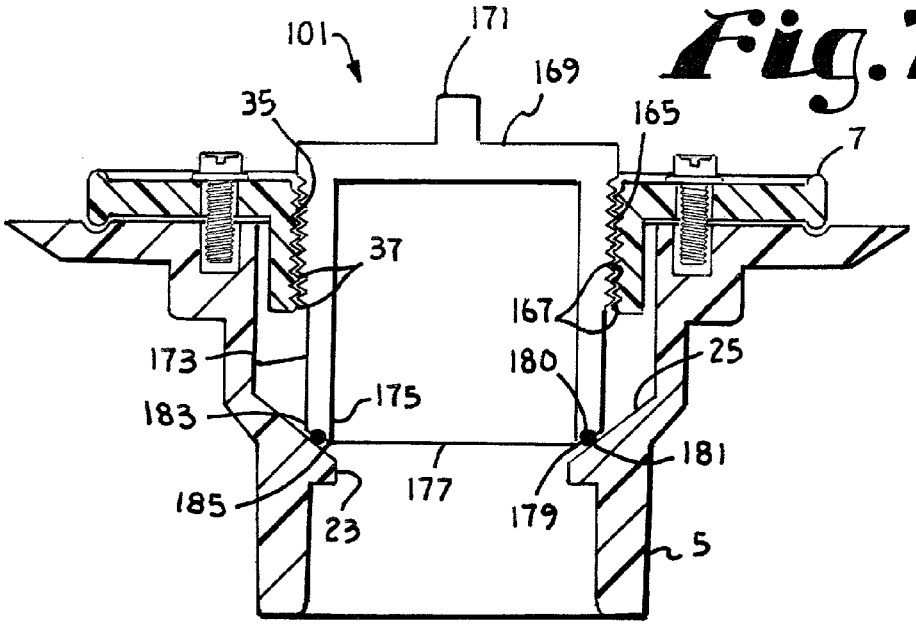
FIG. 7 is a view similar to FIG. 5 showing an alternative embodiment of the test plug.

FIG. 7 shows an alternative embodiment of the shower drain test plug 1 which is designated herein as plug 101. The plug 101 is similar to the plug 1 except that it is adapted to engage and seal against the upper annular wall 25 of the drain body, instead of sealing against the side wall 23. Like the plug 1, the plug 101 includes an upper threaded portion 165 having external threads 167 sized to engage the internal threads 37 of the aperture 35. A top wall 169 sealingly covers an upper end of the threaded portion 165. Gripping means 171 are provided on the plug 101 for gripping by hand or with a wrench, pliers, or the like for turning the plug 101 in the aperture 35. A cylindrical extension 173 extends downwardly from the threaded portion 165 to a sealing portion 175 proximate a lower end 177 of the plug 101.

The sealing portion 175 includes a bottom wall 179, which is an annular wall if the plug 181 is hollow. The bottom wall 179 has an annular groove 180 formed therein which receives an elastomeric sealing ring 181. The bottom wall 179 is downwardly angled from an outer edge 183 thereof to an inner edge 185 of the bottom wall 179 if the plug 101 is hollow, or toward a center of the plug 101 if the plug 101 is solid. The angle of the bottom wall 179 is selected to generally correspond to the angle of the upper annular wall 24 of the drain body 5, however the angles need not be identical.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A test plug for temporary installation in a drain including a body and a collar removably connectable to the body, the body having a drain bore with a cylindrical side wall, the collar including a collar aperture above and in axial alignment with the cylindrical side wall, the collar aperture having internal threads, said test plug comprising:

a) a threaded portion having external threads sized to be received in the collar aperture; and b) a sealing portion spaced downwardly from said threaded portion, said sealing portion including sealing means for sealing off the drain bore and having a diameter less than a diameter of the collar aperture so as to be insertable into the drain bore through the collar aperture.

2. The test plug as in claim 1 wherein said sealing portion is spaced from said threaded portion by a cylindrical extension.

3. The test plug as in claim 1 wherein said sealing means includes an elastomeric sealing ring.

4. The test plug as in claim 3 wherein said sealing ring is positioned on a bottom wall of said sealing portion of said test plug for sealingly engaging an annular wall of said body extending into said bore.

5. The test plug as in claim 4 wherein said bottom wall is angled downwardly from an outer edge thereof toward the center of the test plug.

6. The test plug as in claim 5 wherein said bottom wall is annular and is angled downwardly from said outer edge to an inner edge positioned radially inward of said outer edge.

7. The test plug as in claim 3 wherein said sealing ring is positioned on a circumferential surface of said sealing portion of said test plug for sealingly engaging a cylindrical side wall encircling said bore.

8. A test plug for temporary installation in a drain including a body and a collar removably connectable to the body, the body having a drain bore with a cylindrical side wall and an annular wall extending into the drain bore above the cylindrical side wall, the collar including a collar aperture above and in axial alignment with the cylindrical side wall, the collar aperture having internal threads said test plug comprising:

a) a threaded portion having external threads sized to be received in the collar aperture;

b) a sealing portion spaced downwardly from said threaded portion, said sealing portion including sealing means for sealing off the drain bore, said sealing means including an elastomeric sealing ring positioned on a circumferential surface of said sealing portion for sealingly engaging the cylindrical side wall; and c) an alignment tab extending radially outward from said test plug above said elastomeric sealing ring, said alignment tab positioned for engaging the annular wall of the drain and acting to align said sealing ring with the cylindrical side wall of the drain.

9. The test plug as in claim 8 wherein said alignment tab is a first alignment tab and said test plug further includes a second alignment tab extending outwardly from said test plug in a direction diametrically opposite said first alignment tab.

10. A test plug for temporary installation in a drain including a body and a collar removably connectable to the body, the body having a drain bore with a cylindrical side wall, the collar including a collar aperture above and in axial alignment with the cylindrical side wall, the collar aperture having internal threads, said test plug comprising:

a) a threaded portion having external threads sized to be received in the collar aperture;

b) an extension extending downwardly from said threaded portion;

c) a cylindrical sealing portion connected to said extension below said threaded portion and spaced apart from said threaded portion, said sealing portion having a diameter less than a diameter of the collar aperture so as to be insertable into the drain bore through the collar aperture; and d) an elastomeric sealing ring extending circumferentially around said sealing portion for sealing engagement with the cylindrical side wall of the drain bore.

11. The test plug as in claim 10 for use in a drain which further includes an annular wall extending into the drain bore above the cylindrical side wall thereof, said test plug further including an alignment tab extending radially outward from said test plug above said elastomeric sealing ring, said alignment tab positioned for engaging the annular wall of the drain to align said sealing ring with the cylindrical side wall of the drain.

12. The test plug as in claim 11 wherein said alignment tab is a first alignment tab and said test plug further includes a second alignment tab extending outwardly from said sealing portion in a direction diametrically opposite said first alignment tab.

13. In combination, a drain and a test plug for temporary installation in said drain, said drain having a drain bore with a threaded bore portion having internal threads and a cylindrical side wall below said threaded bore portion, and said test plug comprising:

a) a threaded plug portion having external threads sized to be received in said threaded bore portion of said drain;

b) an extension extending downwardly from said threaded plug portion;

c) a cylindrical sealing portion connected to said extension below said threaded plug portion and spaced apart from said threaded plug portion, said sealing portion having a diameter less than a diameter of said threaded bore portion so as to be insertable into said drain bore through said threaded bore portion; and d) an elastomeric sealing ring extending circumferentially around said sealing portion for sealing engagement with said cylindrical side wall of said drain bore.

14. In combination, a drain and a test plug for temporary installation in said drain, said drain having a drain bore with a threaded bore portion having internal threads, a cylindrical side wall below said threaded bore portion and an annular wall extending into said drain bore above said cylindrical wall, and said test plug comprising:

a) a threaded plug portion having external threads sized to be received in said threaded bore portion of said drain;

b) an extension extending downwardly from said threaded plug portion;

c) a cylindrical sealing portion connected to said extension below said threaded plug portion and spaced apart from said threaded plug portion; and d) an elastomeric sealing ring extending circumferentially around said sealing portion for sealing engagement with said cylindrical side wall of said drain bore; and e) an alignment tab extending radially outward from said test plug above said elastomeric sealing ring, said alignment tab positioned for engaging said annular wall to align said sealing ring with said cylindrical side wall of said drain bore.

15. The combination as in claim 14 wherein said drain includes a channel extending downwardly through said internal threads of said threaded bore portion and said alignment tab of said test plug has a width less than a minimum width of said channel such that said test plug may be inserted into said drain bore by aligning said alignment tab with said channel and pressing said test plug into said drain bore.

16. The combination as in claim 14 wherein said cylindrical side wall of said drain bore is an internal margin of a pipe stop.

17. The combination as in claim 14 wherein said cylindrical side wall of said drain bore is relatively narrow.

18. The combination as in claim 14 wherein said alignment tab is a first alignment tab and said test plug further includes a second alignment tab extending outwardly from said sealing portion in a direction diametrically opposite said first alignment tab.

19. The combination as in claim 18 wherein said drain includes a pair of diametrically spaced channels extending downwardly through said internal threads of said threaded bore portion and said alignment tabs of said test plug each have a width less than a minimum width of said channels such that said test plug may be inserted into said drain bore by aligning said alignment tabs with said channels and pressing said test plug into said drain bore.

20. In combination, a drain and a test plug for temporary installation in the drain, the drain including a body and a collar removably connectable to said body, said body having a drain bore with a cylindrical side wall and an annular wall extending into said drain bore above said cylindrical side wall, said collar including an aperture above and in axial alignment with said drain bore, said aperture having internal threads, the threads being interrupted by a pair of diametrically spaced channels extending downwardly through said internal threads, and the test plug comprising:

a) a threaded portion having external threads sized to be received in said aperture of said collar;

b) an extension extending downwardly from said threaded portion;

c) a cylindrical sealing portion connected to said extension below said threaded portion and spaced apart from said threaded portion, said sealing portion having a diameter selected to closely match said internal diameter of said cylindrical side wall of said drain bore;

d) an elastomeric sealing ring extending circumferentially around said sealing portion for sealing engagement with said cylindrical side wall of said drain bore; and e) first and second alignment tabs extending radially outward from said test plug in diametrically opposed directions above said elastomeric sealing ring, said alignment tabs positioned for engaging said annular wall to align said sealing ring with said cylindrical side wall of said drain, each said alignment tab having a width less than a minimum width of a respective one of said channels in said threads of said collar such that said test plug may be inserted into said drain bore by aligning said alignment tabs with said channels and pressing said test plug into said drain bore.

21. The combination as in claim 20 wherein said cylindrical side wall of said drain bore is an internal margin of a pipe stop.

22. The combination as in claim 20 wherein said cylindrical side wall of said drain bore is relatively narrow.

* * * * *